United States Patent [19]

Martinez et al.

[11] Patent Number: 4,592,220

[45] Date of Patent: Jun. 3, 1986

[54] SYSTEM AND METHOD FOR THE IN PRESS ADJUSTMENT OF WORKPIECE HOLDING FORCE

[75] Inventors: Miguel R. Martinez; Zygmunt M. Andrevski; William J. Mitchell, Jr., all of Mercer County, N.J.

[73] Assignee: RCA Corporation, Princeton, N.J.

[21] Appl. No.: 638,557

[22] Filed: Aug. 7, 1984

[51] Int. Cl.[4] ..... B21D 22/00

[52] U.S. Cl. ..... 72/16; 72/19; 72/352; 72/417

[58] Field of Search ..... 72/350, 352, 12, 16, 72/19, 20, 21, 22, 23, 24, 417

[56] References Cited

U.S. PATENT DOCUMENTS

| | | | |
|---|---|---|---|
| 3,453,848 | 7/1969 | Williamson | 72/28 |
| 3,817,076 | 6/1974 | Wallace | 72/351 |
| 4,056,965 | 11/1977 | Heiser | 72/351 |
| 4,121,449 | 10/1978 | Celi | 72/350 |
| 4,125,009 | 11/1978 | Byrd | 72/350 |
| 4,306,436 | 12/1981 | Schulz et al. | 72/16 |
| 4,408,471 | 10/1983 | Gossard | 72/21 |
| 4,470,287 | 9/1984 | Antonov et al. | 72/350 |

FOREIGN PATENT DOCUMENTS

| | | | |
|---|---|---|---|
| 159228 | 9/1984 | Japan | 72/350 |

*Primary Examiner*—Francis S. Husar
*Assistant Examiner*—Jerry Kearns
*Attorney, Agent, or Firm*—E. M. Whitacre; D. H. Irlbeck; L. L. Hallacher

[57] ABSTRACT

A system for the automatic adjustment of the pressure pad holding force in accordance with the thickness of the workpiece and the forming tool stroke includes a force transducer and a displacement transducer. The force transducer is used to monitor the force between the pressure pad and the workpiece. The output of the displacement transducer is continually read as the part is being formed. The workpiece thickness and forming tool stroke are used to calculate the optimum holding force. The pressure of a fluid system is adjusted to change the holding force to the optimum value.

16 Claims, 3 Drawing Figures

SYSTEM AND METHOD FOR THE IN PRESS ADJUSTMENT OF WORKPIECE HOLDING FORCE

BACKGROUND

This invention relates generally to the forming of metal parts and particularly to the in press adjustment of the workpiece holding force in accordance with the thickness of the workpiece.

The quality of parts made by forming thin sheets of metal, such as the parts for the electron gun of a color television kinescope, is highly dependent upon the thickness of the material from which the parts are formed. Deviation in the metal thickness from the nominal value results in changes of the required forming force and pressure pad holding force. These variations in forces produce parts for which the bending, spring back and wall thinning is very difficult to predict and compensate. Additionally, changes in the forming forces contribute to excessive wear and fatigue of the dies from which the parts are formed, and thus substantially reduce the life of the dies.

Currently, the metal forming industry measures the thickness of the stock based upon a discrete quality control scheme in which samples from lots are selected and the thickness of the samples measured. Typically, the samples are selected from the ends of the roll and therefore the sample measurements are not necessarily indicative of the thickness of the metal in the middle of the roll. For these reasons, the pressure pad holding forces can be either excessive or deficient because the sample thicknesses are used to calculate the holding forces. Accordingly, there is a need for a system for automatically optimizing the pressure pad holding force in accordance with the actual thickness of the workpiece. The instant invention fulfills this long felt need.

CROSS REFERENCE TO RELATED APPLICATIONS

This invention can be used with the system described in U.S. application Ser. No. 638,551 entitled "IN PRESS WORK PIECE THICKNESS MEASURING SYSTEM AND METHOD", filed on even date herewith by M. R. Martinez and W. J. Mitchell.

DETAILED DESCRIPTION

Figure 1:
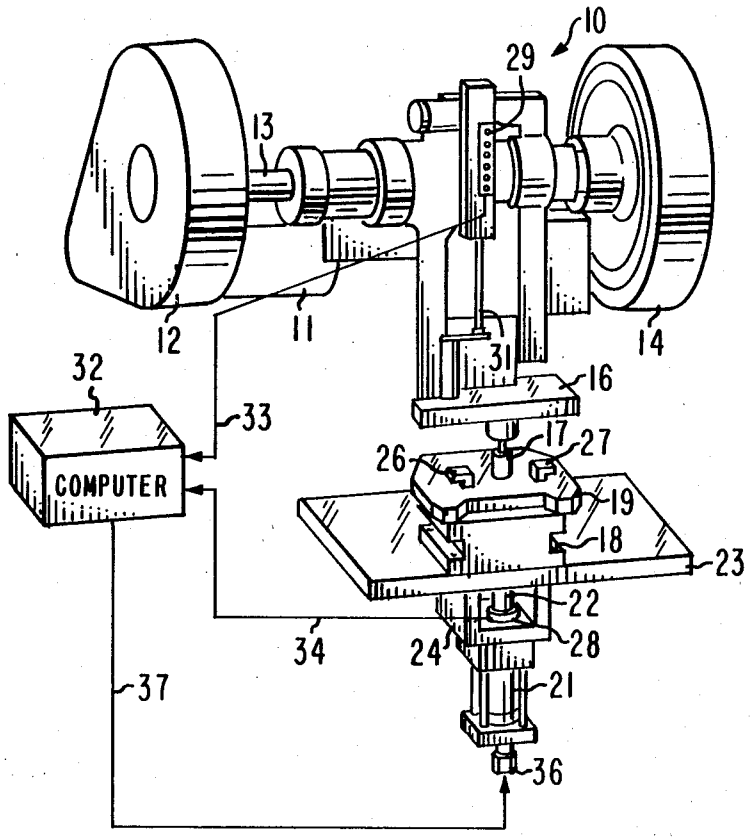
FIG. 1 shows a modified prior art press incorporating an embodiment of the instant invention.

In FIG. 1 a modified prior art press 10 includes a motor 11 which drives a gear contained in a protective housing 12. The gear drives a shaft 13 which drives a flywheel 14. The flywheel energy drives a ram 16 downwardly when a part is to be formed. Coupled to the ram 16 is a forming tool 17 which is configured to form the part. A die 18 is arranged beneath the forming tool 17 and also is configured and dimensioned to form the desired part. A pressure pad 19 is arranged above the die 18 and is used to clamp a workpiece 38 (FIG. 2) in position on the die. The holding of the workpiece between the pressure pad 19 and the die 18 is effected by use of a fluid cylinder 21 having a shaft 22 which operates against the bottom of a base plate 23. Coupled to the cylinder 21 is a fork shaped member 24 having feet 26 and 27 which extend through the pressure pad 19. Actuation of the cylinder 21 causes the feet 26 and 27 to act against the top surface of the pressure pad 19 to compress the workpiece between the pressure pad 19 and the die 18.

A force transducer 28, which in the preferred embodiment is a quartz crystal, is arranged between the fork shaped member 24 and the shaft 22. The output of the force transducer 28 therefore is a signal which is directly representative of the force with which the pressure pad 19 presses against the workpiece against the die 18.

A displacement transducer 29, which in the preferred embodiment is a linear variable differential transformer (LVDT), is mounted on the stationary portion of the press 10. A core 31 is associated with the LVDT and is coupled to the ram 16 to accurately measure the displacement of the ram. Accordingly, the LVDT produces an output signal which is directly proportional to the displacement of the ram 16. The output signal of the LVDT 29 is provided as an input to a computer 32 by a line 33. The output of the force transducer 28 is also provided as an input to the computer 32 by a line 34. The computer 32 computes the optimum holding force that the pressure pad 19 applies to the work piece in accordance with the measured thickness of the workpiece. The computed force signal is provided by the computer 32 to a fluid control mechanism 36 by a line 37. Details of the computer 32 and the calculation methods are provided hereinafter with the respect to FIG. 3.

Figure 2:
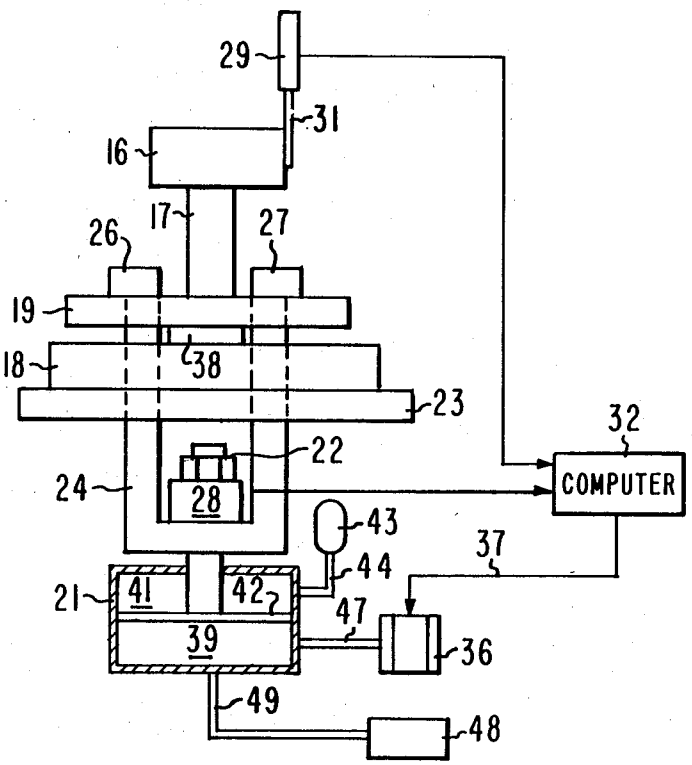
FIG. 2 is a simplified schematic diagram of the press of FIG. 1.

In FIG. 2, a workpiece 38 is arranged between the die 18 and the pressure pad 19. The cylinder 21 includes a pressure control chamber 39 and a constant pressure chamber 41 separated by a piston 42 to which the shaft 22 is attached. An accumulator 43 is charged to a predetermined pressure which is communicated to the constant pressure chamber 41 by a fluid coupling 44. The pressure in the constant pressure chamber 41 forces the piston downwardly into the chamber 39 causing the shaft 22 to pull the feet 26 and 27 of the fork member 24 against the pressure pad 19. Accordingly, the predetermined pressure to which the accumulator 43 is charged determines the maximum force with which the pressure pad 19 acts against the workpiece 38. The maximum force is applied to the pressure pad 19 when the control chamber 39 is maintained at atmospheric pressure and essentially no force is applied to the pressure pad 19 when the chambers 39 and 41 are at equal pressures. The fluid control mechanism 36, which in the preferred embodiment is an electrohydraulic pressure relief valve, communicates with the pressure control chamber 39 by way of a fluid coupling 47. A fluid source 48, such as a pump, provides fluid to the control chamber 39 by way of a fluid coupling 49. The force with which the pressure pad 19 acts against the work piece 38, is determined by the difference in pressure between the chambers 39 and 41. This pressure difference is controlled by controlling the pressure within the pressure control chamber 39. The pressure within chamber 39 is controlled by utilizing the electrohydraulic pressure relief valve 36 to vary the pressure within the chamber in a desired fashion. The relief valve is electrically controlled to establish the pressure in accordance with the electrical signal. Such valves are commercially available, for example a CGE-06-1-2 model relief valve available from Vickers can be used. Accordingly, the control signal provided by the computer 32 to the relief valve 36 over the line 37 can be defined as any desired function of the thickness t of the workpiece 38, $F=g(t, \chi)$. As an example, the force F of the pressure pad 19 against the workpiece 38 can be defined as $F=Kt\chi$ where:

F is the pressure pad force

K is a spring constant t is the workpiece thickness $\chi$ is the ram displacement required to form the part after the workpiece is contacted.

This function for the force F would simulate the spring biasing of the pressure pad 19 against the workpiece 38. Additionally, other functions, such as $F=e^t\chi$ and $F=At \sin \chi$ can be utilized as the definition of the force applied to the pressure pad. In these force definitions the terms F, t and $\chi$ are as defined above and A is a constant. Such a wide variety of pressure pad force definitions is possible because the pressure control is achieved by relieving pressure from the pressure control chamber 39 so that the response time is much less than it would be if pressure were added to the chamber 41 when an increase in the pressure pad force was needed. Accordingly, the pressure pad force can be controlled in the desired manner by generating an electrical signal which meets the desired definition and applying the signal to the control input of the electro-hydraulic pressure relief valve 36. Because the force transducer 28 is compressed between the shaft 22 and the fork 24, the output signal of the transducer is indicative of the pressure pad force.

As is known to those skilled in the art, the optimum holding force with which the pressure pad 19 presses the workpiece 38 against the die 18 is a function of the thickness t of the workpiece. Thus, as shown in the Table, which is taken from page 15–55 of the Tool and Manufacturing Engineer's Handbook 1976 3rd edition, published by McGraw Hill, an accurate in press measurement of the thickness t of the workpiece 38 permit a more precise adjustment of the pressure pad force to the optimum force set forth in the Table.

OPTIMUM HOLDING FORCE AS A FUNCTION OF THICKNESS

| Thickness of stock, inch | Constant, lb required per inch of circumference |
|---|---|
| 0.010 | 820 |
| 0.015 | 788 |
| 0.020 | 757 |
| 0.025 | 727 |
| 0.030 | 698 |
| 0.035 | 670 |
| 0.040 | 645 |
| 0.045 | 618 |
| 0.050 | 593 |
| 0.055 | 569 |
| 0.060 | 546 |
| 0.065 | 524 |
| 0.070 | 503 |
| 0.075 | 483 |
| 0.080 | 466 |
| 0.085 | 448 |
| 0.090 | 431 |
| 0.095 | 415 |
| 0.100 and over | 400 |

As fully explained in copending application Ser. No. 638,551, the displacement transducer 29 output signal is used in cooperation with the output of a force transducer associated with the ram 17 to calculate the thickness t of the workpiece 38. The values of the Table can be stored in the computer 32 and the optimum pressure pad holding force determined in accordance with the measured thickness t of the workpiece 38. Alternatively, the pressure pad force can be varied in accordance with a function of the workpiece thickness t when such variation is advantageous.

Figure 3:
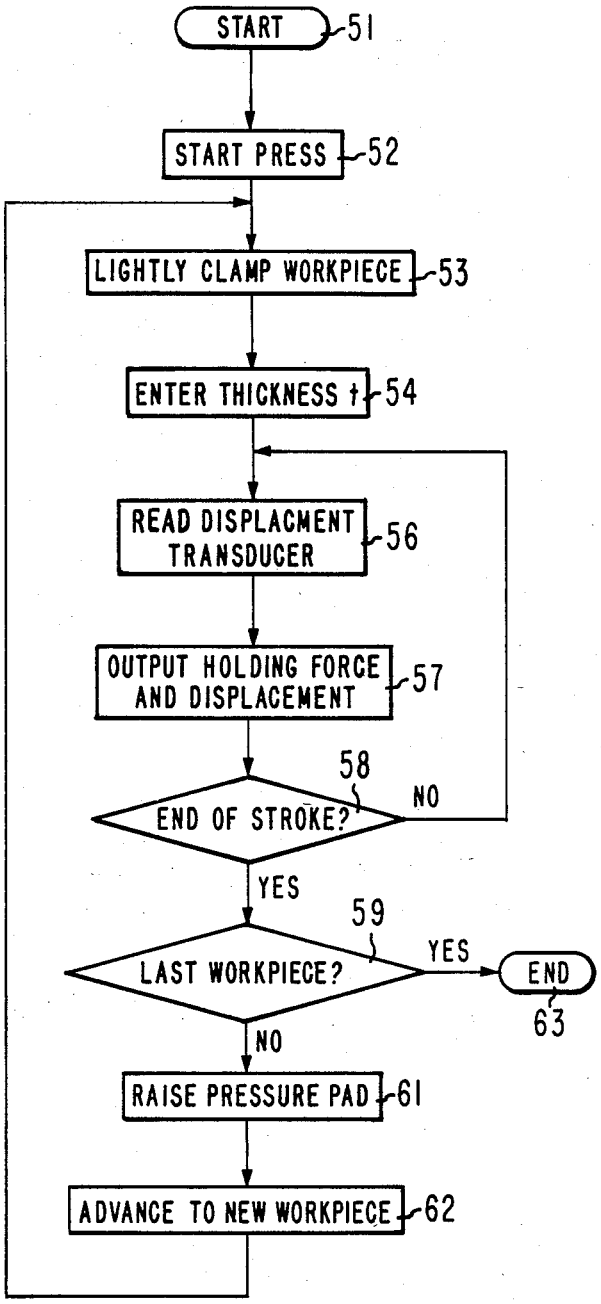
FIG. 3 is a preferred embodiment of the computer utilized in the system of FIG. 1.

FIG. 3 is a flow chart of a preferred embodiment of the computer 32 of FIGS. 1 and 2. The determination of the optimum holding force starts at 51. At step 52 the press 10 (FIG. 1) is started and the motor 11 rotates the flywheel 14 to allow the press 10 to build up the required energy for forming the part. At step 53 a light holding force is applied to the workpiece 38 by the pressure pad 19 to assure that the vibration of the press does not cause the workpiece to move within the press. Step 54 is entered and the workpiece thickness is entered by the system fully described in copending application Ser. No. 638,551. The displacement transducer 29 is continuously read, as shown by step 56. Step 57 is then entered to calculate the optimum holding force which should be applied to the workpiece by the pressure pad 19. Typically, this is done by comparing the measured thickness with the thicknesses set forth in the Table and which are are stored in the computer 32. The measured thickness is compared to the stored thickness values and the required holding force determined in accordance with the values of the Table, the known peripheral dimensions of the part being formed, and the output of the displacement transducer 29. The optimum holding force signal is applied by the computer output line 37 to reset the pressure setting of the relief value 36 (FIG. 2) to the desired pressure. The pressure within the control chamber 39 is changed to the pressure established by the relief valve 36 and the pressure pad holding force is changed to the optimum value. At decision 58, the output of the displacement transducer 29 is read until the forming tool stroke set into the system at step 54 as part of the workpiece thickness calculation is completed. The forming tool stroke subsequent to initial contact with the workpiece 38 is determined by the dimension of the part being formed. Thus, for example, the formation of a one-inch (2.54 cm) deep recess would require a one-inch forming tool stroke. As the formed dimension increases, the required holding force increases. Accordingly, the forming tool stroke is the $\chi$ term in the above holding force F definitions. Thus, the displacement transducer 29 and the force transducer 28 are continuously read while the part is being formed. When the part is fully formed at the end of the forming tool stroke, decision 59 is entered. When the last part has been formed the operation ends at 63. When an additional part is to be formed, the pressure pad is raised at step 61 and the workpiece 38 advances within the press 10 at step 62 to provide material for the next part. This advancement is used when a number of parts is formed from a continuous strip of material using progressive dies. Step 53 is then reentered to lightly clamp the workpiece and repeat the part forming procedure.

What is claimed is:

1. A method of optimizing the holding force on the pressure pad of a press in accordance with the formed dimension of a part and in accordance with the thickness of a workpiece to be formed into said part by said press, said press having a forming tool and a die which cooperate to form said part, a force transducer and a displacement transducer comprising the steps of:

applying an initial holding force to said pressure pad and continuously monitoring said holding force with said force transducer;

providing the thickness of said workpiece from said displacement transducer and also providing a correlation of optimum holding forces for a variety of workpiece thicknesses;

moving said forming tool to form said workpiece into said part while monitoring said force transducer and said displacement transducer; and calculating said optimum holding force in accordance with said workpiece thickness and the output of said displacement transducer; and adjusting said holding force to one of said optimum forces.

2. The method of claim 1 wherein said press includes a fluid system for controlling said holding force, and wherein said holding force adjsutment is effected by changing the pressure of said fluid system.

3. The method of claim 2 wherein said pressure change is made in accordance with the expression $F=Kt\chi$ where:

F=the pressure pad force

K=spring constant t=workpiece thickness $\chi$=forming tool displacement required to form the part after the workpiece is contacted to simulate the holding force of a spring.

4. The method of claim 2 wherein said pressure change is made in accordance with the expression $F=e^{t\chi}$ where:

e=log base e t=workpiece thickness $\chi$=forming tool displacement required to form the part after the workpiece is contacted.

5. The method of claim 2 wherein said pressure change is made in accordance with the expression $F=At \sin \chi$ where:

t=workpiece thickness

A=a constant $\chi$=forming tool displacement required to form the part after the workpiece is contacted.

6. The method of claim 3 wherein said fluid system is hydraulic.

7. The method of claim 4 wherein said fluid system is hydraulic.

8. The method of claim 5 wherein said fluid system is hydraulic.

9. A system for adjusting the workpiece holding force of a forming press having a die and a forming tool which cooperate to form a part from a workpiece in said press, said press also having a pressure pad for applying said holding force to said workpiece, said system adjusting said holding force in accordance with the thickness of said workpiece and the stroke of said forming tool, said system comprising:

means operatively connected to said pressure pad for applying an adjustable holding force to said pressure pad;

force transducer means responsive to said pressure pad for continuously monitoring said holding force and providing a force signal;

displacement transducer means responsive to said forming tool for providing a displacement signal representative of said forming tool stroke;

computer means operatively connected to said force transducer means, said holding force adjustment means and said displacement transducer means for defining optimum holding tool forces in accordance with a variety of workpiece thicknesses and forming tool strokes, said computer means receiving said force signal, said displacement signal and one of said workpiece thicknesses to provide an optimum holding force signal to said means for applying an adjustable holding force, whereby said pressure pad holding force is optimized in accordance with said workpiece thickness and said forming tool stroke.

10. The system of claim 9 wherein said means for applying an adjustable holding force is a fluid system having a pressure control chamber for pulling said pressure pad against said workpiece and also having means for varying the pressure in said chamber to vary said holding force.

11. The system of claim 10 wherein said pressure in said chamber is varied in accordance with the expression $F=Kt\chi$ where:

F=the pressure pad force

K=a spring constant t=workpiece thickness $\chi$=forming tool displacement required to form the part after the workpiece is contacted to simulate the holding force of a spring.

12. The system of claim 10 wherein said pressure in said chamber is varied in accordance with the expression $F=e^{t\chi}$ where:

F=pressure pad force e=log base e t=workpiece thickness $\chi$=forming tool displacement required to form the part after the workpiece is contacted.

13. The system of claim 10 wherein said pressure in said chamber is varied in accordance with the expression $F=At \sin \chi$ where:

F=pressure pad force

A=a constant t=workpiece thickness $\chi$=forming tool displacement required to form the part after the workpiece is contacted.

14. The system of claim 11 wherein said fluid system is hydraulic.

15. The system of claim 12 wherein said fluid system is hydraulic.

16. The system of claim 13 wherein said fluid system is hydraulic.

* * * * *